United States Patent [19]

Martin

[11] Patent Number: 4,490,871

[45] Date of Patent: Jan. 1, 1985

[54] RECIPROCATING ROTARY BRUSH

[76] Inventor: Paul H. Martin, 2168 County Line Rd., Spring Hill, Fla. 33526

[21] Appl. No.: 528,623

[22] Filed: Sep. 1, 1983

[51] Int. Cl.[3] ..... A47K 7/04; A46B 13/06

[52] U.S. Cl. ..... 15/21 R; 128/56

[58] Field of Search ..... 15/21 R, 21 B, 21 C, 15/21 D, 21 E, 97 R; 4/606; 128/51–53, 56, 62 R

[56] References Cited

U.S. PATENT DOCUMENTS

| | | | |
|---|---|---|---|
| 1,609,796 | 12/1926 | Cheney | 15/121 R X |
| 3,042,949 | 7/1962 | Mosely | 15/21 R |
| 3,085,269 | 4/1963 | Greer | 15/21 R |
| 3,768,462 | 10/1973 | Boulard | 15/21 R X |
| 4,151,623 | 5/1979 | Steere | 15/21 R |

*Primary Examiner*—Edward L. Roberts
*Attorney, Agent, or Firm*—Ronald E. Smith

[57] ABSTRACT

An apparatus of the type designed to be mounted in a shower stall. The apparatus includes a rotatably mounted brush member that oscillates in a vertical plane or a horizontal plane depending upon the selection chosen by the user of the invention. Water is diverted from the shower head to rotate a water wheel that is enclosed within a housing, the rotation of the water wheel effecting rotation of the brush. The brush is provided with a first gear that is forced to travel along a second gear that forms an elongated oval configuration so that the brush travels either up or down or sideways depending upon the alignment of the elongate second gear. The elongate second gear is mounted about its periphery by a plurality of spring members, the spring members being employed to introduce play into the apparatus to facilitate the orbiting of the second gear by the first gear.

5 Claims, 10 Drawing Figures

FIG_6
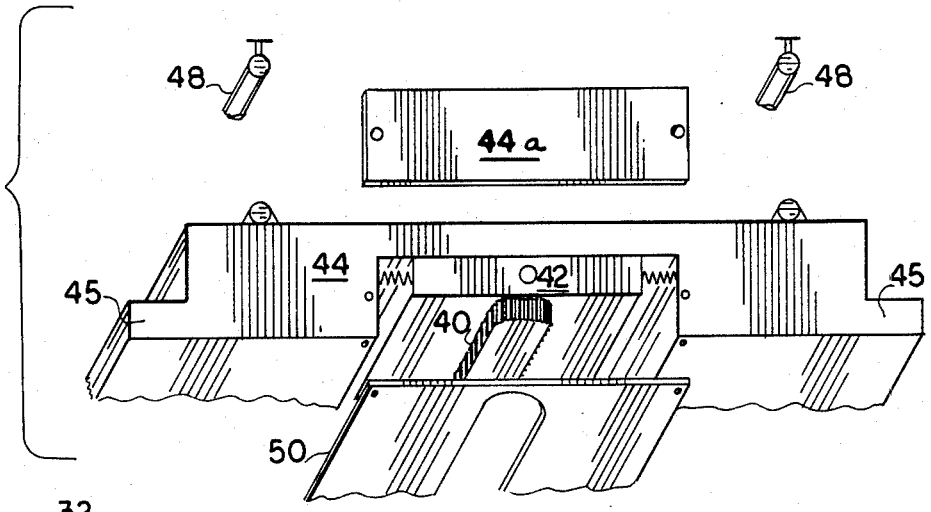
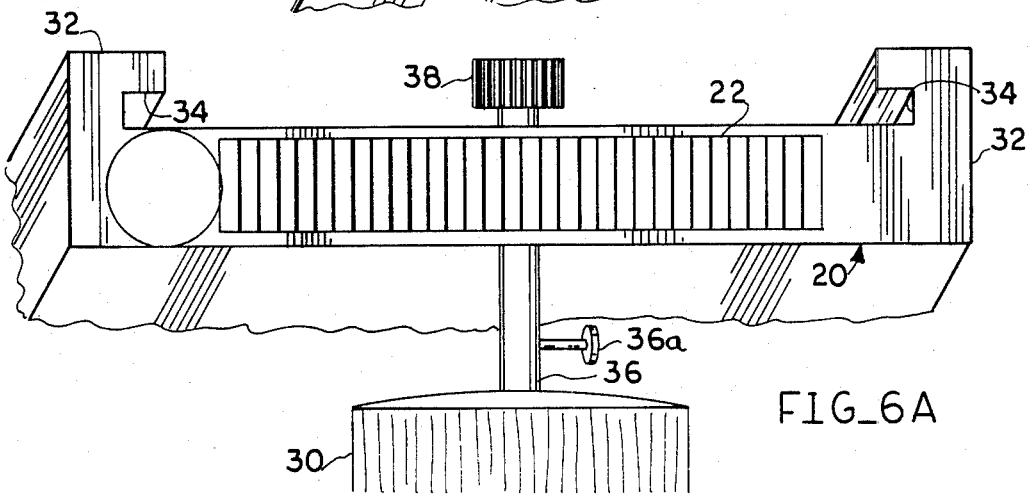
FIG_6A

RECIPROCATING ROTARY BRUSH

BACKGROUND OF THE INVENTION

1. Field of the Invention

This invention relates, generally, to back scrubbing devices, and more specifically relates to a back scrubbing device that oscillates in a vertical or horizontal plane.

2. Description of the Prior Art

A search of United States patents that was conducted prior to the filing of this disclosure located the following patents in the general field of this invention;

| Patentee | U. S. Pat. No. | Date of Issue |
|---|---|---|
| Mosely | 3,042,949 | 07/10/62 |
| Greer | 3,085,269 | 04/16/63 |
| Steere | 4,151,623 | 05/01/79 |
| Kadlub | 4,155,137 | 05/22/79 |

Rotatable, shower stall mounted brush members for scrubbing one's back, as shown by the results of the search, are well known. However, the state of the art limits the position of the brush to a fixed position, with the result that the person taking a shower must move his or her body relative to the brush in order to adequately cleanse his or her back. There is a need for a brush member that will not only rotate responsive to water flow, but that will also oscillate in a vertical or horizontal plane responsive to water flow, but such a device does not appear in the prior art.

SUMMARY OF THE INVENTION

The longstanding but heretofore unfulfilled need for a shower-mounted, rotatable back scrubbing brush is now provided in the form of a brush member that can travel the height or width of one's back.

A brush member is rotated by a water wheel means enclosed in a housing that is rotated by water that is diverted from the main water inlet to the shower head. The amount of water diverted is small so that the volume of water being discharged from the shower head remains adequate. A first pinion gear member is fixedly secured to and rotates conjointly with the water wheel and with the brush member, and such pinion gear is continuously engaged with an elongate rack-like gear member.

The rack-like gear member is surrounded by a frame member and is interconnected with said frame by a plurality of bias means. Thus, the rack member can be displaced from its equilibrium position. An elongate slot is formed in a plate member through which the stem that interconnects the brush, housing member, and pinion gear extends. In this manner, the slot constrains the pinion gear to continuously engage the rack-like gear with the result that the pinion gear will travel first in one direction along the length of the rack-like gear, will secondly travel in a second direction substantially at right angles to the first direction of travel for a short distance, and thirdly will travel in a direction parallel to, but opposite in direction to, the first direction. A fourth direction at right angles to the third direction returns said pinion gear to its original position. Thus, the pinion gear is seen to follow a race track, or elongated oval course, as it orbits the rack-like gear.

The housing for the rack-like gear is mounted for vertical displacement on a pair of wall mounting members so that the position of the entire assembly may be vertically adjusted.

The frame for the rack-like gear is provided with a swivel mount so that the rack-like gear can be positioned in a vertical plane or a horizontal plane. In the latter position, the brush moves laterally with respect to the user's back, so that the lumbar region thereof may be scrubbed, if desired.

It is therefore seen that the primary object of the invention is to provide a rotatable back-scrubbing brush that oscillates in a horizontal or vertical plane.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 6 is a fragmentary perspective view of the frame assembly for the rack-like gear.

FIG. 6A is a partially cutaway, top plan view of the brush assembly.

DETAILED DESCRIPTION OF THE PREFERRED EMBODIMENT

Figure 1:
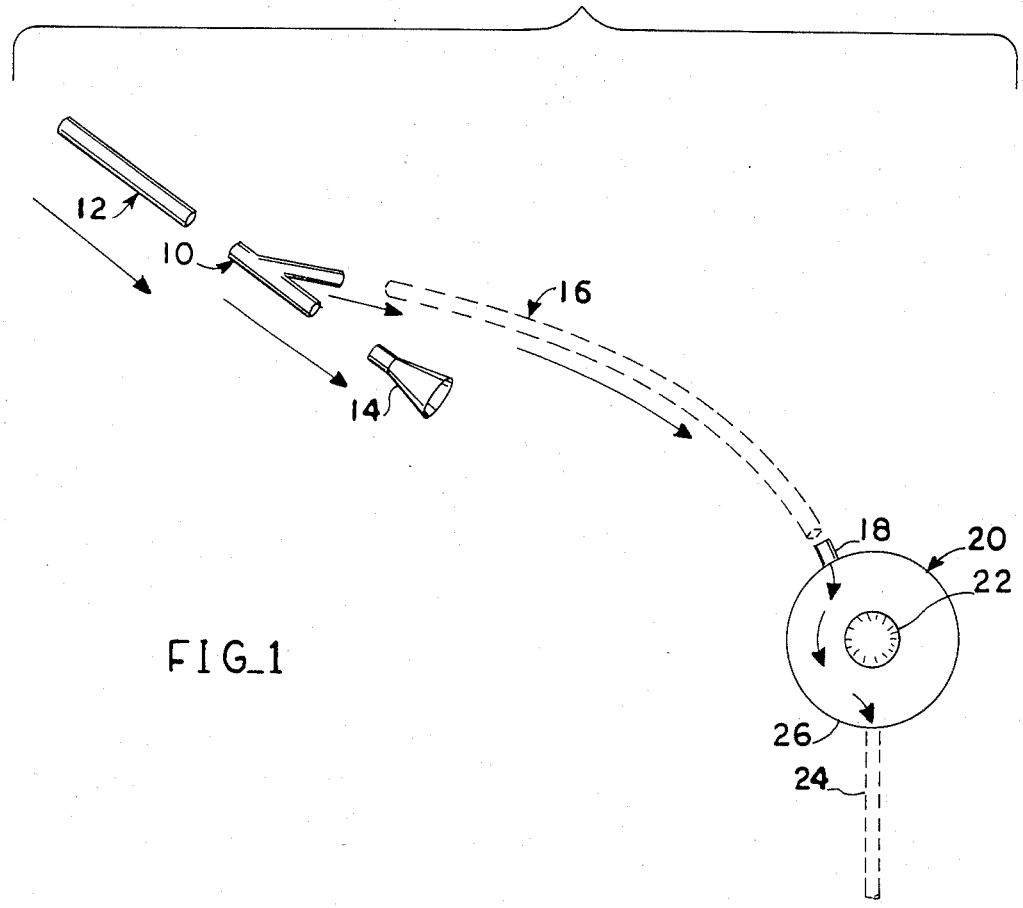
FIG. 1 diagrammatically depicts how water is diverted from a shower head line into the housing for the water wheel that turns the novel brush.

Referring now to FIG. 1, it will there be seen that a diverter valve 10 is shown installed in a main water inlet line 12 that establishes fluid communication between a municipal source of fluid under pressure and a shower head means 14. The diverter valve is a "Y"-shaped member, and diverts water flow into a flexible hose means 16 that is coupled to an inlet member 18 that forms a part of the housing 20 that houses a water wheel member shown diagrammatically as at 22 in FIG. 1. Water flowing through flexible hose 16 will impinge upon the blades of the water wheel 22 and impart rotation thereto, as is well known. Water 24 will then be discharged from the housing through an outlet means designated 26, said outlet means comprising a screen member 28, shown in FIG. 2B. The screen 28 will break the water 24 discharging from exit 26 into a fine mist.

Except for the screen 28, the elements of the invention shown in FIG. 1 are well known in the art.

Figure 2:
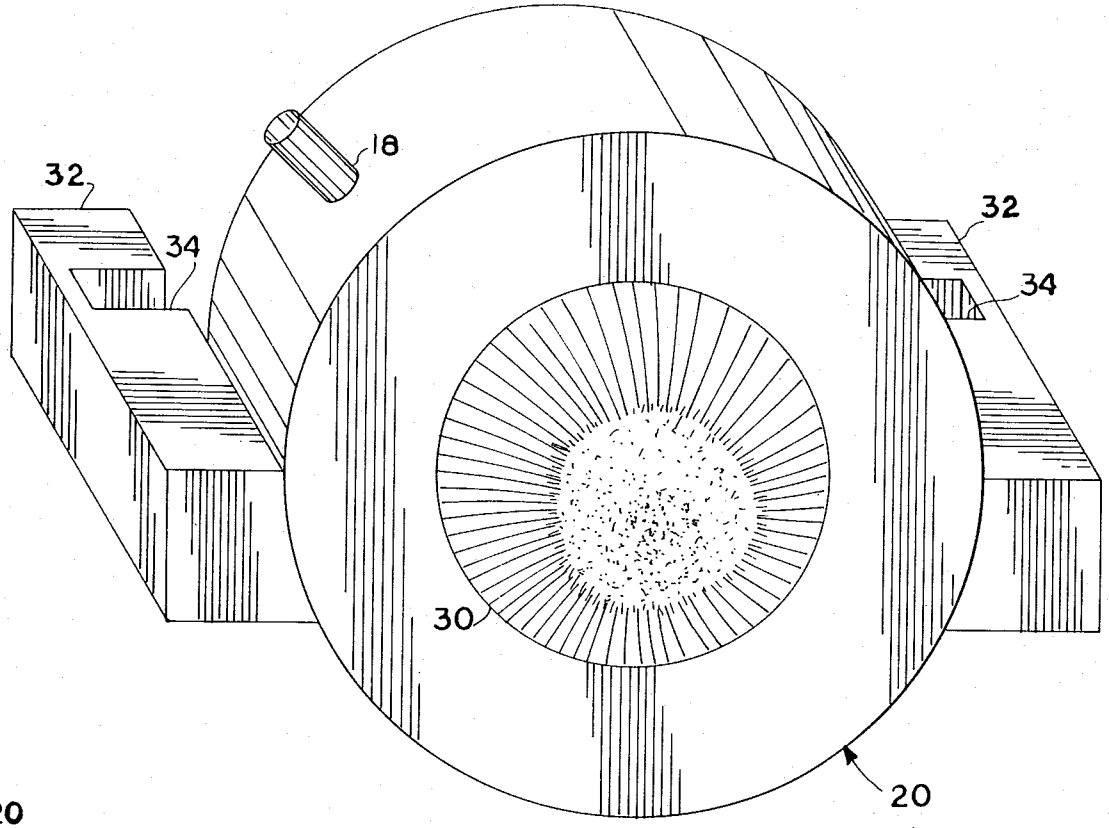
FIG. 2 is a perspective view of the novel brush member.
Figure 2B:
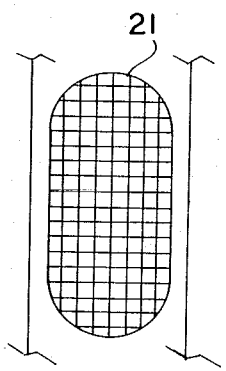
FIG. 2B is a detail of the screen at the bottom of the brush shown in FIG. 2.

The housing 20 is shown in greater detail in FIG. 2. The rotatable brush member 30 is preferably mounted centrally of the housing 20, as shown. The housing 20 includes a pair of laterally spaced arm members 32 that define square in configuration openings 34 the purpose of which will become clear as this description proceeds.

Figure 2A:
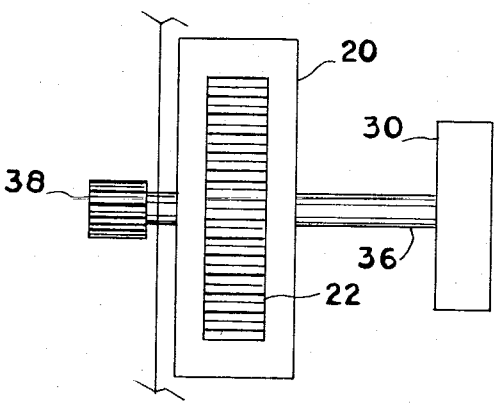
FIG. 2A is a side elevational view, fragmentary, partially cutaway view of the brush, the water wheel and its housing, and a pinion gear.
Figure 3:
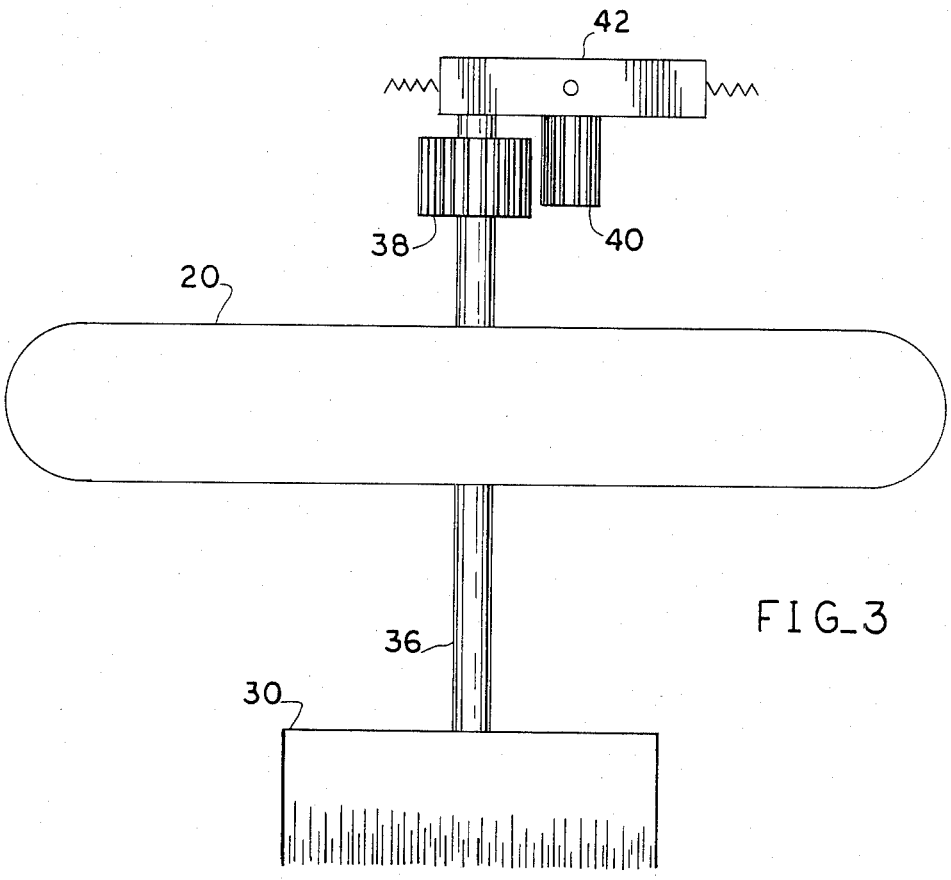
FIG. 3 is a diagrammatic, top plan view of the brush, the housing for the water wheel, the pinion gear and the rack-like gear around which the pinion gear orbits.

As shown in FIG. 2A, brush 30 is rotatably mounted on a stem member 36 upon which is mounted the water wheel 22 interiorly of housing 20. The stem 36 terminates in a pinion gear 38 that rotates conjointly with the water wheel 32 and the brush 30. As shown in FIG. 3, pinion gear 38 is operatively disposed to meshingly engage a second gear member 40 that projects forwardly of a base member 42.

Figure 4:
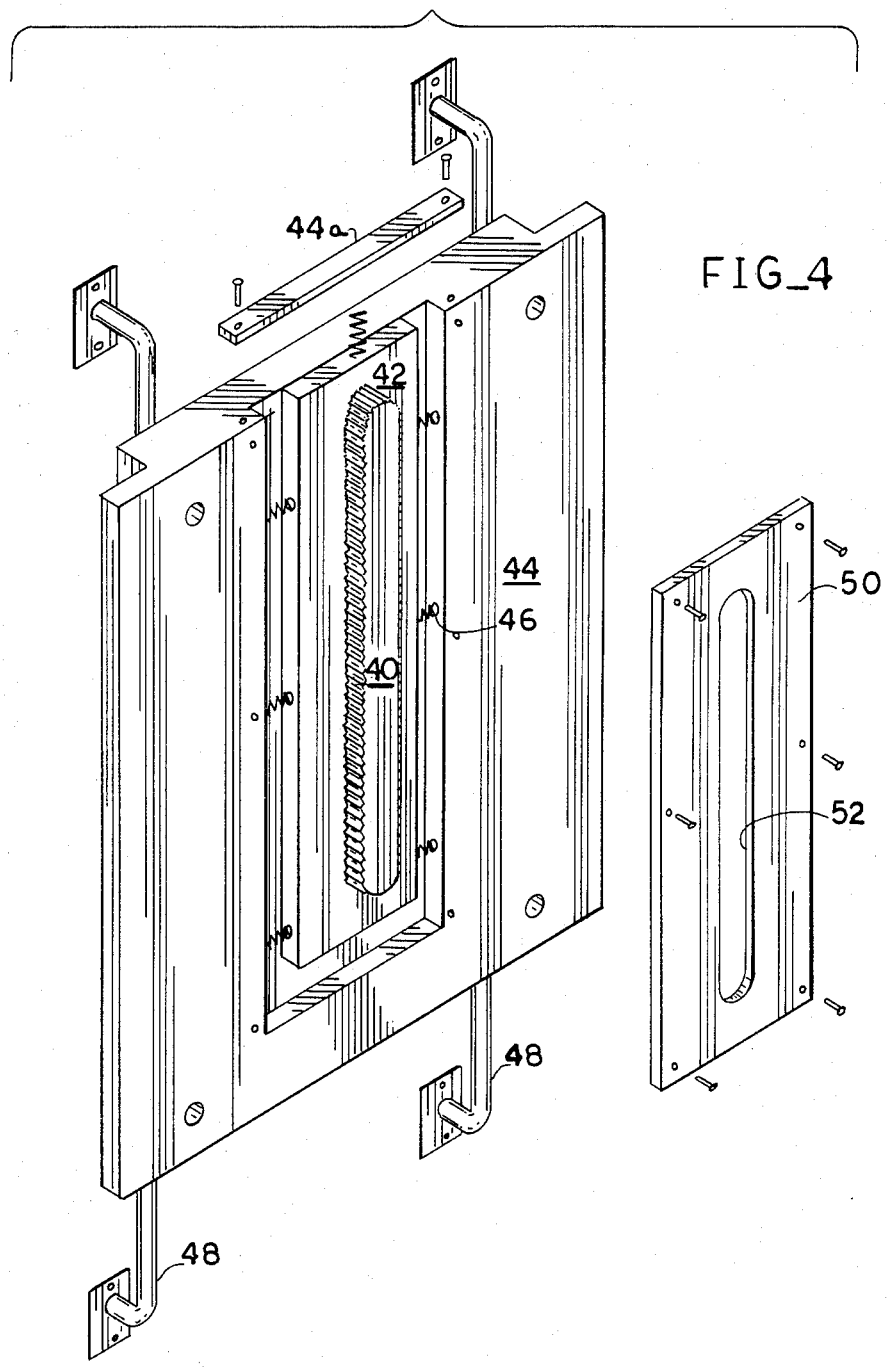
FIG. 4 is a perspective view showing how the rack-like gear is interconnected with its frame by a plurality of spring members.

Referring now to FIG. 4, it will there be seen that the second gear 40 and base member 42 are surrounded by a frame member 44 and cover plate 44*a*, and are interconnected therewith by a plurality of spring members 46 disposed about the perimeter of the base 42 as shown. As such, base 42, and hence gear 40, are transiently displaceable from the equilibrium position depicted in FIG. 4. In a preferred embodiment, the base member 44 is mounted on a pair of rod members 48 that are fixedly secured by suitable means to the wall of the shower stall within which the invention is used. When the invention is in use, the frame means 44 is locked into a preselected position on the rods 48, but it should be understood that the frame 44 can be adjusted upwardly or downwardly from the position shown in FIG. 4. A face plate 50, having an elongate slot 52, is also shown in FIG. 4, and is used to enclose the rack-like gear 40 and its base member 42.

Figure 5:
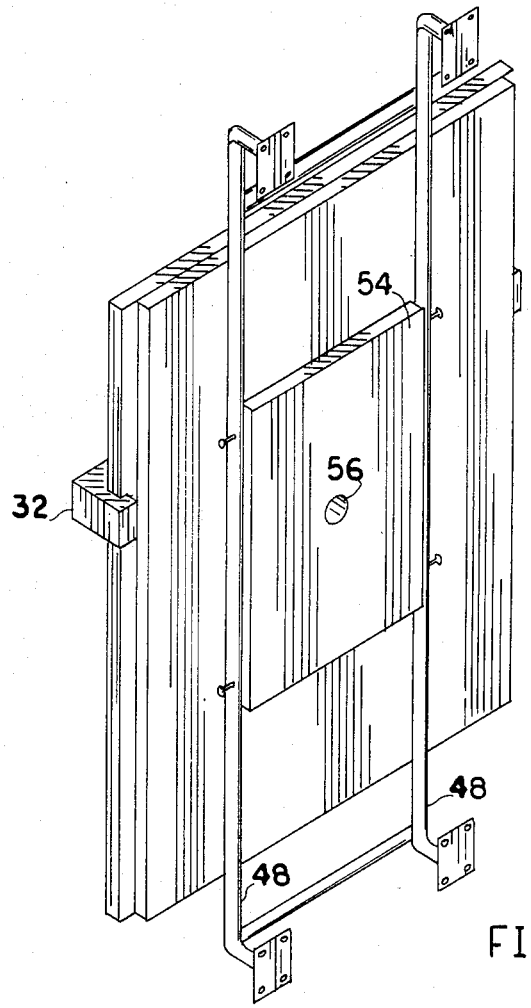
FIG. 5 is a perspective view showing the rear of the unit, showing the swiveling mounting means thereof.
Figure 5A:
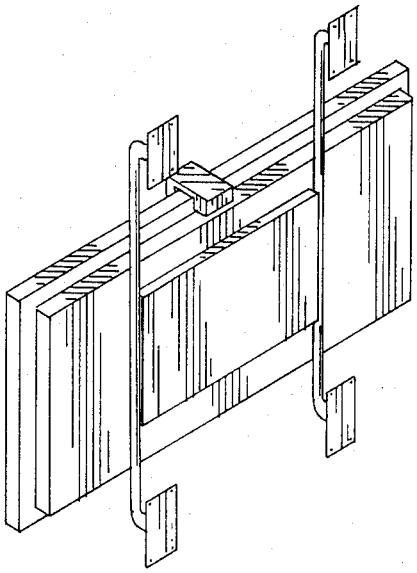
FIG. 5A shows the unit in FIG. 5 rotated 90 (ninety) degrees about its swiveling mount.

As shown in FIGS. 5 and 5A, a pivotable swivel member 54 is provided on the rearward side of base member 44 as shown, and allows such frame member, and hence base member 42, to be positionable in one of two positions when the invention is in use. Specifically, when the apparatus is in the position depicted in FIG. 5, the rotatable brush will oscillate in a vertical plane in a manner to be described hereinafter. However, when the apparatus has been swiveled about pivot point 56, the brush will oscillate in a vertical plane, as suggested by FIG. 5A.

The operation of the inventive device should become clear in connection with an examination of FIGS. 6 and 6A. When the invention is assembled, the aforementioned cutout portions 34 defined by the rearwardly extending arms 32 of brush housing 20 will slideably engage the frame member 44 at its laterally disposed edges 45 that are complementally formed relative to cutout portions 34. The stem 36 will extend through slot 52 formed in face plate 50 and pinion gear 38 will meshingly engage the teeth of rack-like gear 40, as is perhaps best understood by referring again to FIG. 3. As is best understood in connection with FIG. 6A, as water rotates water wheel 28, and hence brush 30 and pinion gear 38, such pinion gear 38 will travel about the perimeter of gear 40. It will be constrained to bear against gear 40 by the slot 52 formed in face plate 50. Since base member 42 is supported about its perimeter by springs 46 as aforesaid, when pinion gear 38 travels to the top of gear 40, the uppermost end of slot 52 will constrain such pinion gear 38 to travel over the top of gear 40, and will then constrain it to begin a downward travel along the opposite side of gear 40. This travel will continue until gear 38 reaches the lowermost portion of gear 40, at which time it will be constrained by the lowermost portion of slot 52 to traverse the lowermost portion of gear 40, and to begin an upward traverse of gear 40, thereby completing one orbit of gear 40. Thus, the brush 30 will rotate as driven by water wheel 22, and will oscillate in a substantially vertical plane, responsive to gear 38 orbiting gear 40 in the manner described. The pivoting of frame member 44 about pivot point 56 as provided by swivel member 54 will allow the brush to oscillate in a horizontal plane.

The slideable movement between the brush housing 20 and the frame member 44 may be facilitated by the provision of roller bearings disposed interiorly of cutout portions 34. Thus, very little water actually needs to be diverted by the diverter valve 10 into the housing 20 to accomplish the desired rotary and transtational movement that is desired.

As shown in FIG. 6A, a set screw 36*a*, having a thumb turn portion to facilitate its manipulation, is provided to act as a brake to slow the rotation of the brush 30, if desired. Advancement of set screw 36*a* causes its distal end to rub against shaft 36.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. An apparatus of the type designed to brush or massage a human back, comprising, in combination, a rotatable brush member having an operative, bristles-carrying front surface, and a non-operative rear surface, a stem means fixedly secured to said rear surface and projecting therefrom such that the respective axes of rotation of said brush member and said stem member are coincident, a first gear member fixedly secured to said stem means so that rotation of said gear member imparts simultaneous and corresponding rotation to said brush member, a second gear member disposed in meshing relation to said first gear member, a gear housing member disposed in surrounding relation to said second gear member, a plurality of bias means disposed in interconnecting relation to said second gear member and said gear housing member so that said second gear member is transiently displaceable from an equilibrium position attendant application of external forces thereagainst, a flat guide member, an elongate slot means formed in said guide member, said brush member mounted with respect to said guide member such that said stem means extends through said slot means, and such that said slot means constrains said first and second gear members to be continuously engaged, means for imparting rotation to said brush member and hence to said first gear member, said second gear member having a longitudinal dimension substantially greater than its transverse dimension and having teeth means about its perimeter so that said first gear means and hence said brush member define a path of travel thereabout, responsive to rotation of said brush member.

2. The apparatus of claim 1, further comprising, a water wheel member adapted to be rotated responsive to water impinging thereagainst, a housing means for said water wheel member, said water wheel member fixedly secured to and conjointly rotatable with said stem means so that water-imparted rotation of said water wheel member imparts simultaneous and corresponding rotation to said brush member and causes said brush member to travel along a path of travel defined by the teeth of said second gear member.

3. The apparatus of claim 2, wherein the housing for said brush member and the housing for said second gear member are slideably mounted with respect to one another, said housing for said second gear member being immoveably mounted during operation of the apparatus so that said brush housing moves slideably with respect to it during such operation.

4. The apparatus of claim 3, further comprising, a base member, said housing for said second gear member mounted on said base member, said base member being swively mounted so that it and consequently said second gear member are positionable in two rotational positions ninety degrees apart to the end that said brush moves in a vertical plane or a horizontal lane dependent upon the rotational position of said swivel member.

5. The apparatus of claim 4, further comprising a diverter valve means for partially diverting water from a shower head means into the housing means for said water wheel member, and wherein said housing means for said water wheel member is provided with a screen means at its lowermost position so that water escaping said housing means through said screen is made into a mist by said screen so that splashing does not occur.

* * * * *